US011698082B2

(12) United States Patent
Niels

(10) Patent No.: US 11,698,082 B2
(45) Date of Patent: Jul. 11, 2023

(54) FAN AND COVER FOR FAN

(71) Applicant: ELEKTROSIL GMBH, Hamburg (DE)

(72) Inventor: Bubke Niels, Hamburg (DE)

(73) Assignee: ELEKTROSIL GMBH, Hamburg (DE)

( * ) Notice: Subject to any disclaimer, the term of this patent is extended or adjusted under 35 U.S.C. 154(b) by 281 days.

(21) Appl. No.: 16/930,531

(22) Filed: Jul. 16, 2020

(65) Prior Publication Data

US 2021/0018015 A1 Jan. 21, 2021

(30) Foreign Application Priority Data

Jul. 16, 2019 (EP) ..... 19186641
Sep. 11, 2019 (EP) ..... 19196756

(51) Int. Cl.
*F04D 29/42* (2006.01)
*F04D 25/06* (2006.01)
(Continued)

(52) U.S. Cl.
CPC ..... *F04D 29/4226* (2013.01); *F04D 25/0693* (2013.01); *F04D 29/002* (2013.01); *F04D 29/023* (2013.01); *F04D 29/403* (2013.01)

(58) Field of Classification Search
CPC .. F04D 29/002; F04D 29/023; F04D 29/0693; F04D 29/403; F04D 29/4226
See application file for complete search history.

(56) References Cited

U.S. PATENT DOCUMENTS 5,699,854 A * 12/1997 Hong ..... H01L 23/467 165/122
7,358,631 B2 * 4/2008 Morishitahara ..... F04D 25/0693 310/71

(Continued)

FOREIGN PATENT DOCUMENTS

DE 20 2008 015041 4/2010
DE 202008015041 U1 * 5/2010 ..... F04D 25/0613
WO 2012061777 5/2012

OTHER PUBLICATIONS

Ebm-Papst, Series 250 Fan Datasheet, Jan. 2016; https://www.mouser.com/datasheet/2/120/ebm_papst_250_rev2016-1880455.pdf (retreived Jun. 17, 2022).*

(Continued)

*Primary Examiner* — Brian P Wolcott
(74) *Attorney, Agent, or Firm* — Grogan, Tuccillo & Vanderleeden, LLP

(57) ABSTRACT

A fan includes an electric motor and a fan wheel drivable or driven by the electric motor, arranged within its housing. The underside of the housing has an opening for an electric outlet, and a side the housing has a bracket, thereby forming a bushing. An electric line is arranged at least partially at the underside of the housing and is guided through the bushing, and a cover element is arranged at the underside of the housing. The cover element has a first section and a second section. The cover element is arranged at the underside of the housing in such a way that the first section is at least partially arranged in the bushing and clamps the electric line in the bushing while forming a strain relief, and that the second section covers the opening.

19 Claims, 7 Drawing Sheets

(51) Int. Cl.

| | |
|---|---|
| ***F04D 29/00*** | (2006.01) |
| ***F04D 29/02*** | (2006.01) |
| ***F04D 29/40*** | (2006.01) |

(56) References Cited

U.S. PATENT DOCUMENTS

| | | | | |
|---|---|---|---|---|
| 9,121,414 | B2 * | 9/2015 | Lofy | F04D 25/068 |
| 2007/0099459 | A1 * | 5/2007 | Otsuki | F04D 25/0693<br>439/144 |
| 2013/0064700 | A1 * | 3/2013 | Wu | F04D 25/0646<br>417/423.7 |

OTHER PUBLICATIONS

EP Search Report issued in EP Patent Application No. 19196756.1 dated Mar. 19, 2020.

* cited by examiner

FAN AND COVER FOR FAN

CROSS REFERENCE TO RELATED APPLICATION

This application claims priority to European Patent Application No. 19186641.7 filed on Jul. 16, 2019, and to European Patent Application No. 19196756.1 filed on Sep. 11, 2019, both of which are hereby incorporated by reference in their entireties.

FIELD OF THE INVENTION

The present invention relates to a fan having a housing, wherein a cover element is arranged at an underside of the housing.

Further, the present invention relates to a cover element for a fan.

BACKGROUND OF THE INVENTION

Fans are used in many different technical applications for cooling electronic devices and components or for ventilation. Fans are used in particular in convenience applications, for example in the automotive industry. In particular in convenience applications, a special attention is directed to the noise emissions of the fans.

For power supply and signal transmitting for other electric interfaces of a fan, it is known to solder an electric line to a printed circuit board arranged inside of the housing of the fan and to guide it outside through an opening of the fan housing. For the ESD protection (electrostatic discharge), the opening then has to be closed, in order to fulfil the technical requirements. As the electric outlet of the electric line is disposed on the printed circuit board inside the housing, it is no longer accessible already at an early stage of the production process. Therefore, due to the installation of the electric line early in the production process, the length of the electric line is determined already and can be changed afterwards only with great efforts. It is also problematic that the early installed electric line has to be carried through the whole further production process, which makes the production of the fan laborious. Additionally, the electric line has to be provided with a strain relief.

SUMMARY OF THE INVENTION

It is the object of the present invention to provide a low-noise fan in which an ESD protection and a strain relief of an electric line provided for power supply and/or signal transmitting for electric interfaces can be carried out in an easy manner. Further, it is the object of the invention to provide a cover element for a fan with which the aforementioned advantages can be achieved.

For the solution of the task on which the invention is based, a fan having a housing is suggested, wherein in the housing an electric motor and a fan wheel drivable or driven by the electric motor are arranged, wherein on an underside of the housing, the housing has an opening for an electric outlet, wherein on a circumferential side the housing has a bracket, so that a bushing is formed between the bracket and the circumferential side, wherein an electric line is arranged at least partially at the underside of the housing and is guided through the bushing, wherein it is further provided that a cover element is arranged at the underside of the housing, wherein the cover element has a first section and a second section, wherein the first section and the second section are arranged at an angle towards each other, and wherein the cover element is arranged at the underside of the housing in such a way that the first section is at least partially arranged in the bushing and clamps the electric line in the bushing while forming a strain relief, and that the second section covers the opening.

The opening can also be arranged in a top side of the housing.

In a top view of the underside of the housing, seen in a radial direction of the housing, the opening is preferably disposed between the axis of rotation of the fan wheel and the circumferential side of the housing.

The electric line is guided through the bushing between the bracket and the circumferential side and from there runs to the opening in the underside of the housing. The circumferential side and the underside of the housing are disposed at an angle of preferably approximately 90° towards each other, so that the electric line runs via the edge at the bushing from the circumferential side to the underside of the housing.

The bracket arranged at the circumferential side of the housing can be attached to the circumferential side unilaterally or with only one bracket end, so that the bushing is open on one side. Further, the bracket can also be attached to the circumferential side bilaterally or with both bracket ends, so that the bushing is formed loop-like.

The cover element according to the invention comprising the first section and the second section is advantageously configured to provide both a strain relief of the electric line and an ESD protection and a sound insulation of the fan. The strain relief is achieved by the fact that the first section is at least partially arranged in the bushing and clamps the electric line in the bushing. Additionally, the second section of the cover element covers the opening, by which the inside of the housing and/or an electric outlet is covered for ESD protection. Further, due to the covering of the opening, noise emissions of the fan are reduced. The cover element at the fan according to the invention has the particular advantage of a combined ESD protection and a strain relief for the electric line in one component.

Preferably, the cover element is essentially formed L-shaped.

Due to the L-form of the cover element, the latter engages around the edge at the transition from the circumferential side to the underside of the housing. The first section runs approximately parallel to the circumferential side. The second section runs approximately parallel to the underside of the housing.

Preferably it is provided that a duct is formed between the second section and the underside of the housing, wherein the electric line is arranged in the duct.

Due to the formation of a duct covered by the second section of the cover element, the electric line arranged therein is protected in the direction of the outside, so that the danger of damage to the electric line in the production process or during the installation in an application is reduced.

With a further advantage it can be provided that the housing in the underside of the housing has a recess which runs in a radial direction, wherein the second section covers the radial recess for forming the duct.

The duct is formed between the cover element and the recess. The recess running in the radial direction preferably runs in the direction of the circumferential side towards the bracket of the strain relief, preferably starting from the opening arranged in the underside of the housing. The electric line, which is guided through the bushing between the bracket and the circumferential side, runs via the edge at the transition between the circumferential side and the underside of the housing and disappears in the duct formed by the recess and the cover element. In the duct, the electric line runs further in the direction of the opening, so that an electric outlet for operating the fan can be provided. The recess can be provided by a respective configuration of the housing wall of the underside of the housing. For this, it can be provided that the housing wall of the underside of the housing is bulged into the housing in the direction of the inside of the housing.

Due to the formation of a duct with a recess, the electric line arranged therein is arranged approximately in the extension level of the underside of the housing. The construction height of the fan can thereby be reduced.

Preferably, it is provided that in an inside of the housing a printed circuit board is arranged, wherein the printed circuit board essentially covers the opening from the direction of an inner side of the housing.

The printed circuit board is further preferably arranged concentrically around the axis of rotation of the fan wheel at the inner side of the housing. Further, the electric motor for driving the fan wheel as well as electronic components for controlling the fan can be arranged on the printed circuit board. The printed circuit board essentially covers the opening from the direction of the inner side of the housing. This leads to a further reduction of noise emissions from the inside of the housing of the fan.

Preferably, an electric outlet can be provided, comprising a first, preferably female, part of a plug connection arranged on the printed circuit board, which protrudes through the opening and is covered by the second section.

For providing the electric outlet, thus preferably a plug connection is provided. A first part of the plug connection, preferably a female part of the plug connection, is arranged on the printed circuit board in such a way that it protrudes through the opening and is covered by the second section. The first part of the plug connection is thus disposed between the printed circuit board and the second section of the cover element. Consequently, the opening is preferably covered on the inner side of the housing by the printed circuit board and on the outside by the second section. Additionally, the opening is widely filled by the first part of the plug connection protruding through the opening. Overall, these measures provide a significant reduction of the noise emissions from the inside of the housing.

With a further advantage it can be provided that the electric outlet comprises a second, preferably male, part of the plug connection arranged at the end of the electric line, which is in operative connection with the first part.

Therefore, particularly preferably, the male part of the plug connection is arranged in the female part of the plug connection. Due to the configuration of the electric outlet as a plug connection comprising the first and the second part, wherein the first part is arranged on the printed circuit board and protruding through the opening, the problem known from prior art, that the electric line for power supply has to be attached to the printed circuit board arranged inside the housing early in the production process of the fan and has to be carried through the remaining production process, is overcome. Thus, the fan comprising housing, fan wheel, electric motor and printed circuit board can be produced essentially in its totality, before the electric line has to be connected. Only in later production stages the electric line is arranged at the fan by connecting the first part of the plug connection with the second part of the plug connection. After this, the cover element is arranged on the underside of the housing in such a way that the second section covers the opening and the electric line and preferably also the plug connection and that the first section of the cover element clamps the electric line in the bushing for producing a strain relief. Also, application-related, the length of the electric line has to be decided only towards the end of the production process.

The first part of the plug connection, in particular the female part of the plug connection, is preferably arranged on or attached to the printed circuit board as an SMD component (surface-mounted device) in an SMT procedure (surface-mounted technology).

Preferably it can be provided that the first section is formed bracket-shaped with two longitudinal bars and one cross bar arranged at the end of the longitudinal bars.

Therefore, an opening is formed between the longitudinal bars and the cross bar as well as a region of the second section facing the first section. Due to the bracket-shaped configuration of the first section, material for the production of the cover element can be saved.

With a further advantage it can be provided that a latching element protruding from the extension level of the first section at an angle is arranged at the cross bar.

If the first section of the cover element is inserted into the bushing between the bracket and the circumferential side of the housing, so that the electric line is clamped in the bushing, the latching element can engage behind the bracket, if the first section is sufficiently deeply guided through the bushing, so that the latching element latches behind the bracket. Thus, the cover element is loss-proof retained at the housing of the fan.

Further preferably, the second section has two longitudinal margin bars and one cover plate extending between the margin bars.

If the underside of the housing has a radial recess, the cover element can be inserted into the recess with the margin bars. The cover plate of the cover element is retained at a distance from the underside of the housing by the margin bars, so that the duct for the electric line is formed between the cover plate and the underside of the housing. Additionally, the cover plate fulfils the function of covering the opening in the underside of the housing respectively the plug connection towards the outside.

With a further advantage it can be provided that the second section has a first partial section and a second partial section, wherein a step is formed on an underside of the cover plate between the first partial section and the second partial section.

The first partial section of the second section of the cover element is preferably arranged adjacent to the first section of the cover element, which is disposed at an angle towards the second section. The second partial section of the second section of the cover element is arranged on the side of the second section facing away from the first section. On the underside of the cover element, the step is arranged between the partial sections. The second partial section of the second section is preferably arranged above the opening of the underside of the housing. If the cover element is arranged at the housing of the fan, the step leads to an increase in the cross section of the duct between the cover element and the underside of the housing in the second partial section. Due to the increased cross section in the region of the opening in the underside of the housing, an increased installation space is provided, in which the plug connection, in particular the first and the second part of the plug connection, can be arranged.

With advantage it can be provided that the second part of the plug connection abuts on the step of the second section, so that the second part of the plug connection is prevented from gliding out of the first part.

The, in particular male, second part of the plug connection is therefore secured at the step in the cover element by a positive locking fit.

Further, it can be provided that the first partial section has a bulged or arched transition region on the underside in the region of the step.

Due to a bulged or arched or tapered transition region, the angle between the first partial section and the step is increased. This has the advantage that the electric line, which runs in the duct below the first partial section to the second partial section, is strained less by compression and bending at the step.

Further advantageously it can be provided that the cover plate at least in the second partial section has wing sections which on a top side of the cover element protrude laterally beyond the margin bars.

If the cover element and in particular the second section of the cover element with the margin bars in the recess is arranged in the recess of the underside of the housing of the fan, the wing sections of the cover plate protrude laterally beyond the margin bars and abut on the underside of the housing of the fan on the side of the recess. Due to this abutting of the wing sections on the underside of the housing, a further noise minimizing is achieved.

Further, it can be preferably provided that an end piece sticks out in the direction of the underside of the cover element at an end of the cover element facing away from the first section.

Preferably, the end piece runs transverse to the ends of the margin bars of the second section facing away from the first section and fulfils two functions. First, the end piece engages behind the plug connection, in particular the female part of the plug connection, on the side opposite the step, so that a relative positioning of the cover element with respect to the plug connection is simplified. Second, the end piece abuts on the underside of the housing of the fan, by which a minimizing of the noise emissions is achieved.

Further, it can be provided that the margin bars each have a latching protrusion at an end facing away from the first section.

With a further advantage it is preferably provided that the latching protrusions at the margin bars engage behind the opening in the underside of the housing.

In the preferred embodiment, in which a radial recess is arranged on the underside of the housing and wherein the margin bars are arranged in the radial recess, the ends of the margin bars facing away from the first section are at least partially arranged in the opening in the underside of the housing of the fan. Here, the latching protrusions engage behind a radial inner region of the opening, so that the cover element is loss-proof retained at the housing by the latching protrusions in cooperation with the latching element of the first section.

The cover element is preferably connectable or connected with the housing by a clip connection.

With a further advantage it can be provided that the latching element engages behind the bracket.

In a further advantageous embodiment it is provided that the cover element consists of an electrically insulating material, in particular of a plastic, a glass or a ceramic.

Due to the configuration of the cover element made from an electrically insulating material, a particularly effective ESD protection is enabled.

A further solution of the task on which the invention is based consists in providing a cover element for a fan as described above.

All aforementioned features and advantages achieved thereby can be analogically transferred to the cover element.

Therefore, it is provided that the cover element comprises a first section and a second section, wherein the first section and the second section are arranged at an angle towards each other, so that the cover element is preferably essentially formed L-shaped.

Preferably, the first section is formed bracket-shaped with two longitudinal bars and a cross bar arranged at the end of the longitudinal bars.

Additionally, a latching element protruding from the extension level of the first section at an angle can be arranged at the cross bar.

Preferably it is provided that the second section has two longitudinal margin bars and one cover plate extending between the margin bars.

Further, the second section can have a first partial section and a second partial section, wherein a step is formed on an underside of the cover plate between the first partial section and the second partial section.

Preferably, the first partial section can have a bulged or arched or tapered transition region in the region of the step.

Preferably it is provided that the cover plate at least in the second partial section has wing sections which on a top side of the cover element protrude laterally beyond the margin bars.

Additionally, an end piece can stick out in the direction of the underside of the cover element at an end of the cover element facing away from the first section.

Preferably, the margin bars each have a latching protrusion at an end facing away from the first section.

Particularly preferably, the cover element consists of an electrically insulating material, in particular of a plastic, a glass or a ceramic.

BRIEF DESCRIPTION OF THE DRAWINGS

The invention will be explained in greater detail hereinafter on the basis of the drawings, in which.

DETAILED DESCRIPTION

Figure 7:
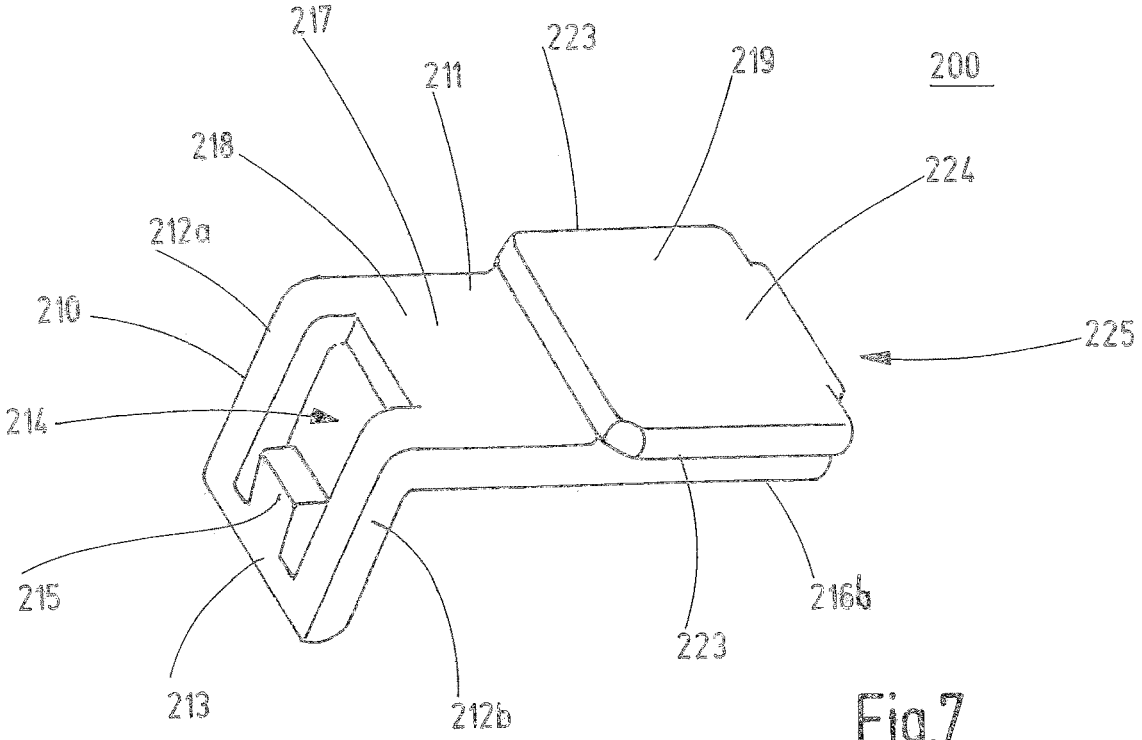
FIG. 7 shows a perspective view of a cover element.
Figure 8:
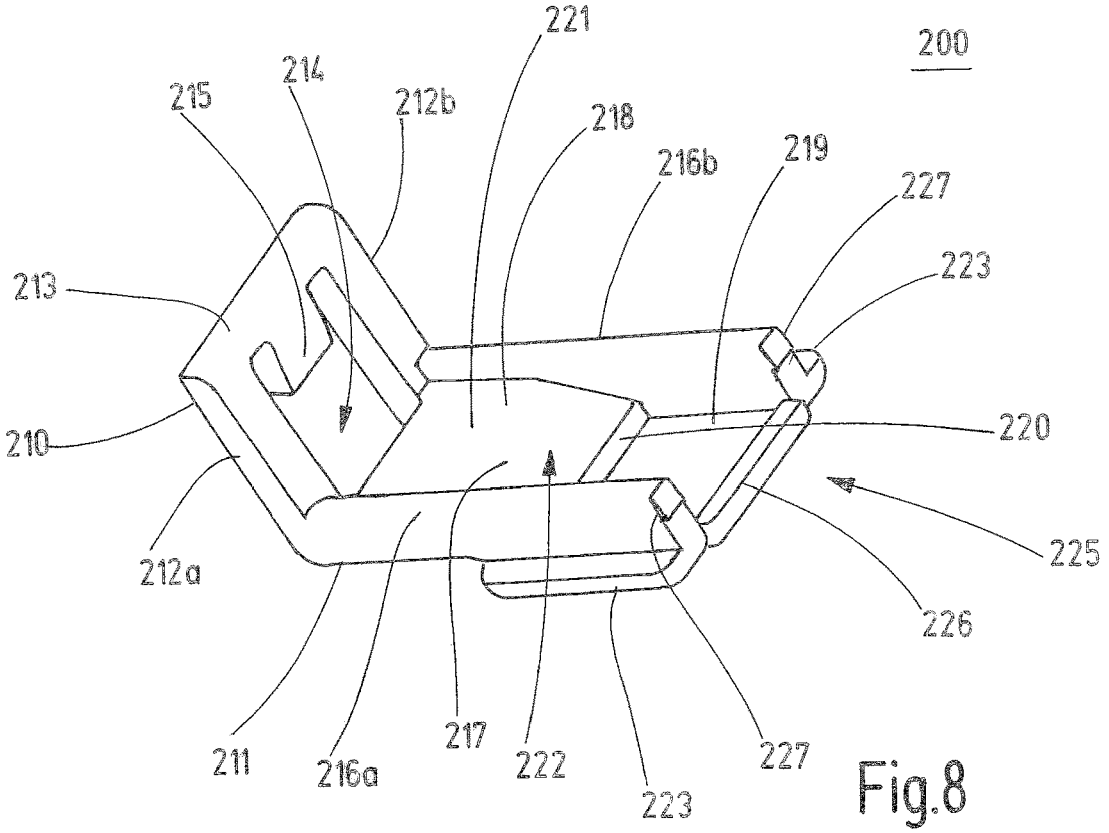
FIG. 8 shows a further perspective view of the cover element.

FIGS. 1 to 6 show a fan 100 in different perspectives. Here, in FIGS. 2 to 6 only parts of the fan 100 are shown for clarity reasons and for better understanding. FIGS. 7 and 8 show a cover element 200 in different perspective views. Identical reference numbers in FIGS. 1 to 8 refer to identical features.

Figure 1:
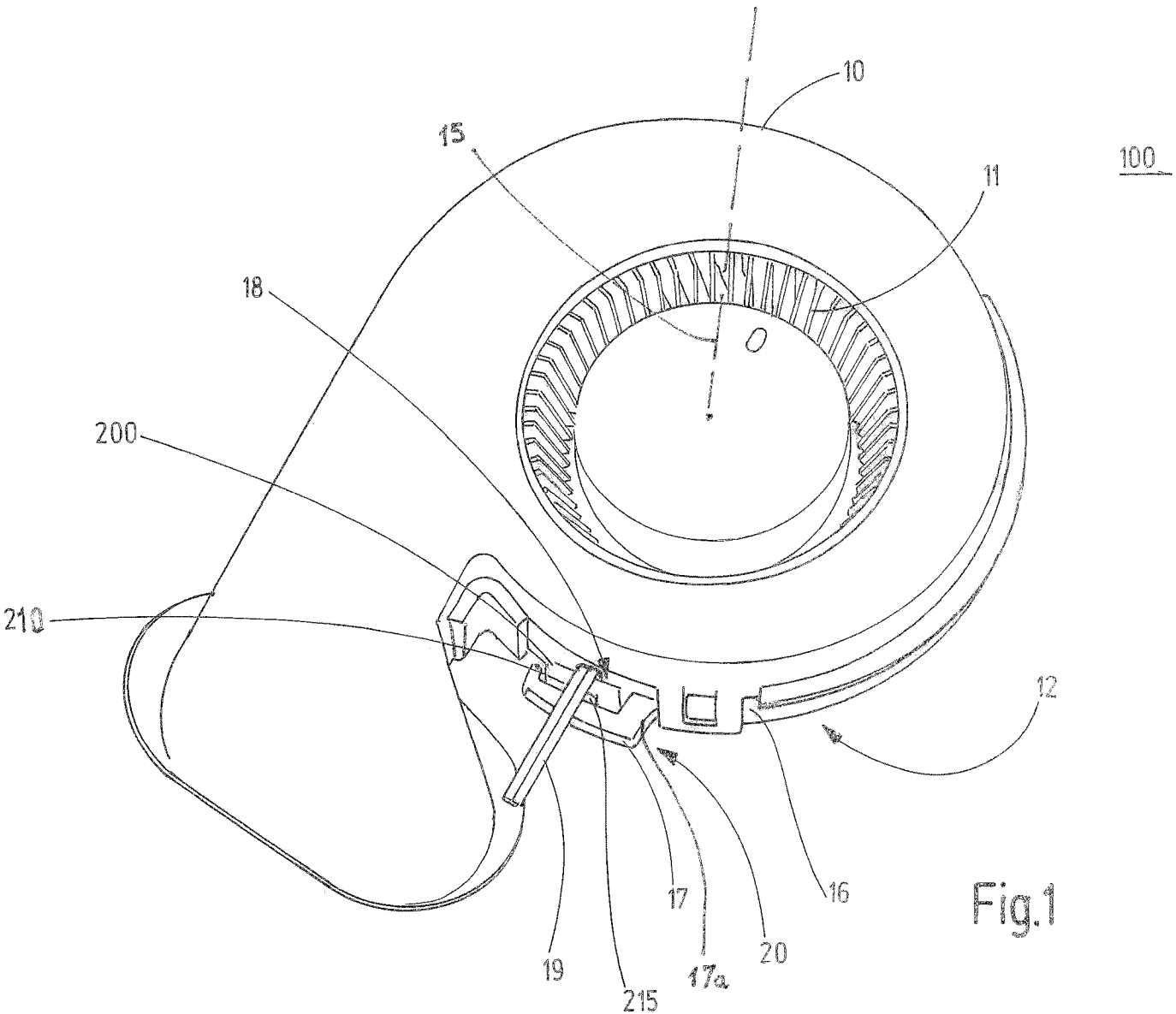
FIG. 1 shows a perspective view of a fan with a housing and a fan wheel.
Figure 2:
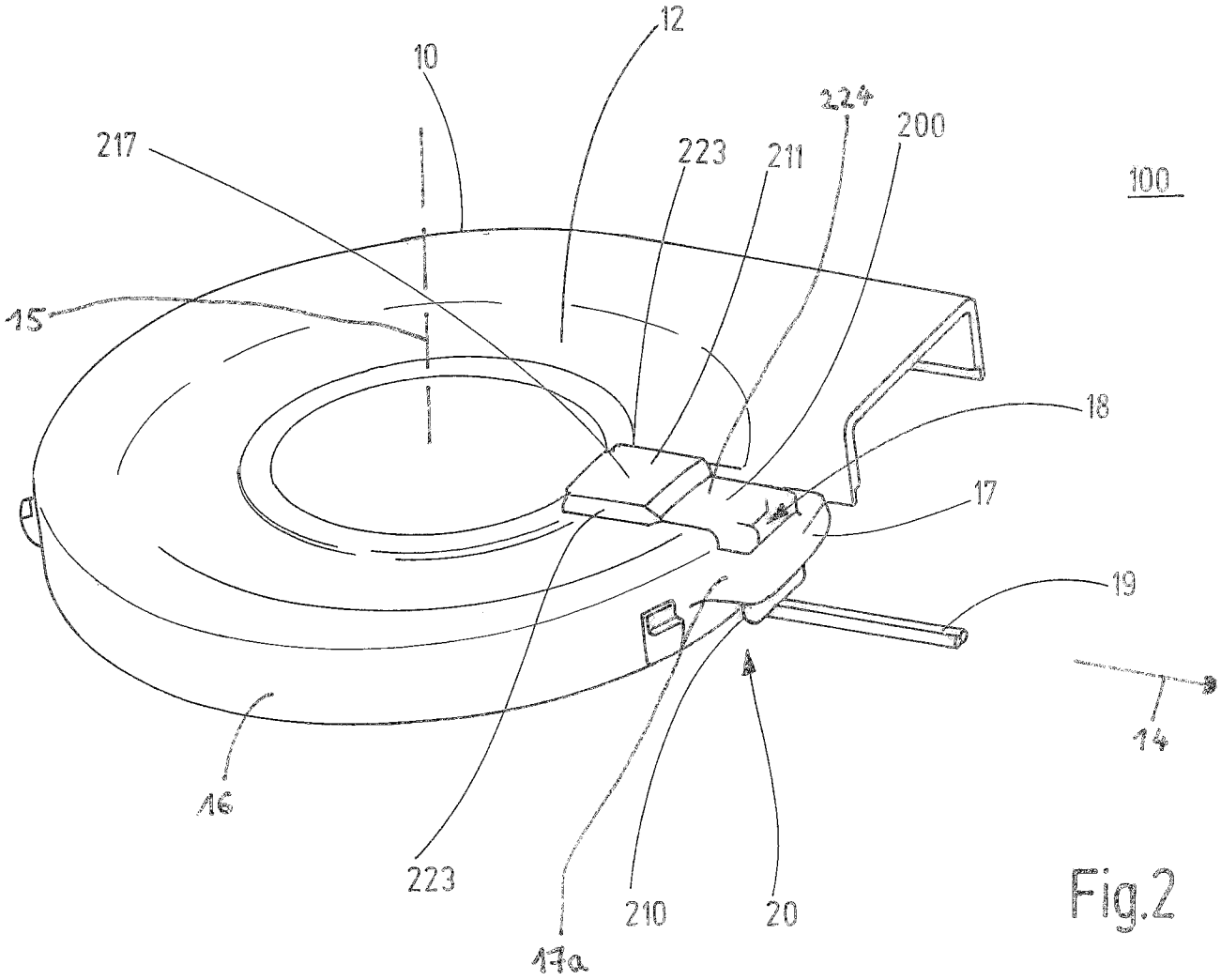
FIG. 2 shows a perspective view of an underside of a housing of the fan with a cover element.
Figure 3:
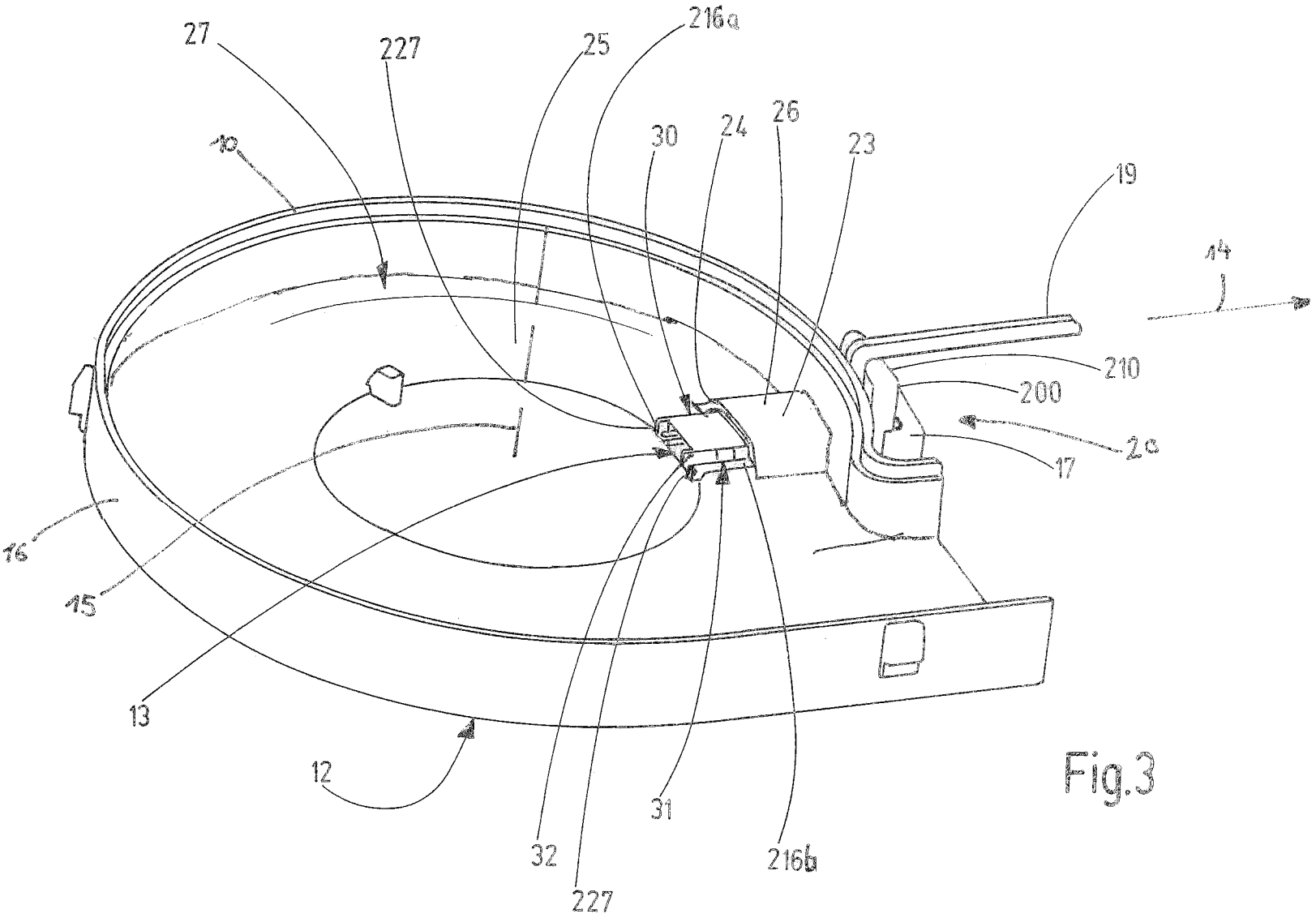
FIG. 3 shows a perspective view of the inner side of the housing of the fan without a printed circuit board.
Figure 4:
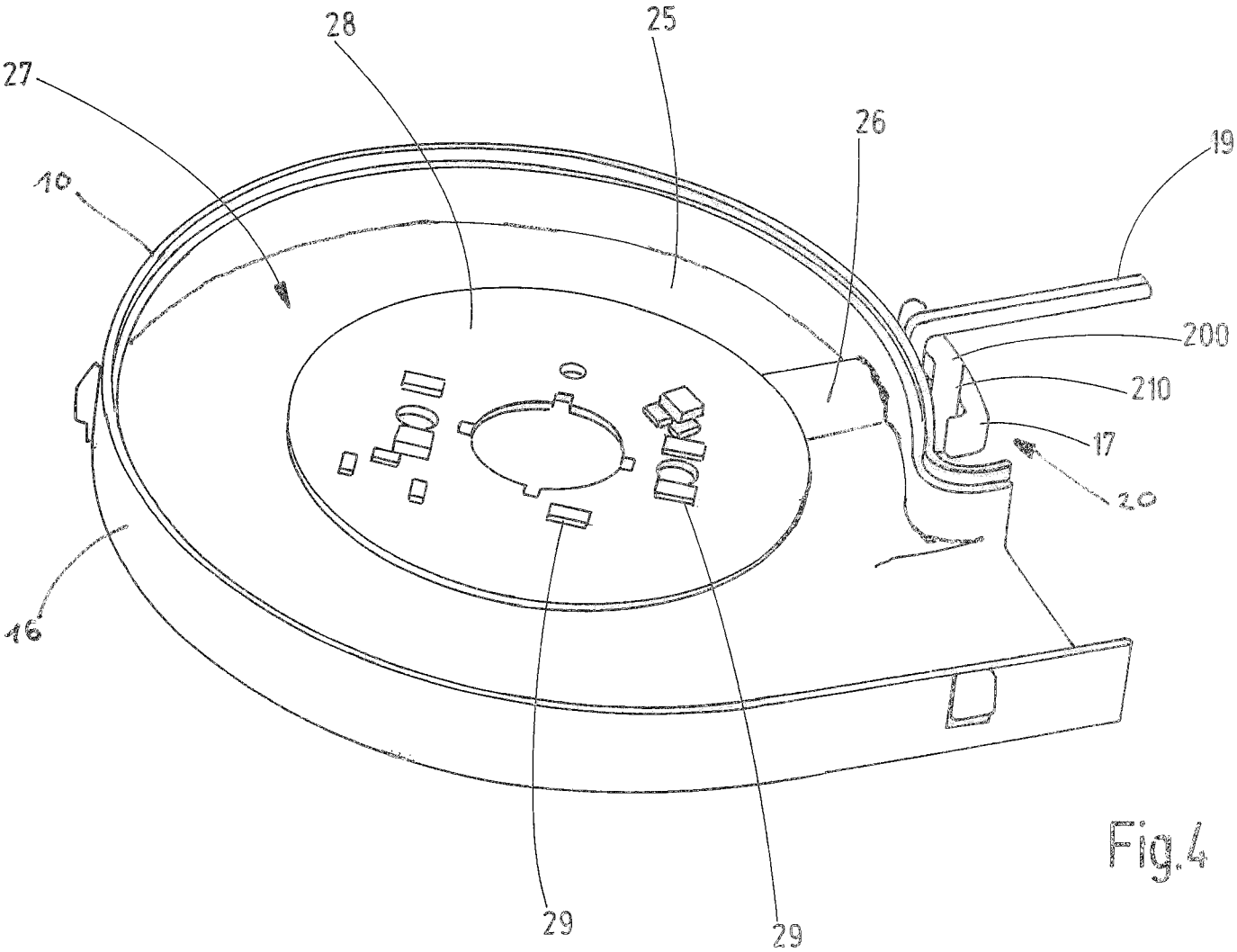
FIG. 4 shows a perspective view of the inner side of the housing of the fan with a printed circuit board.
Figure 5:
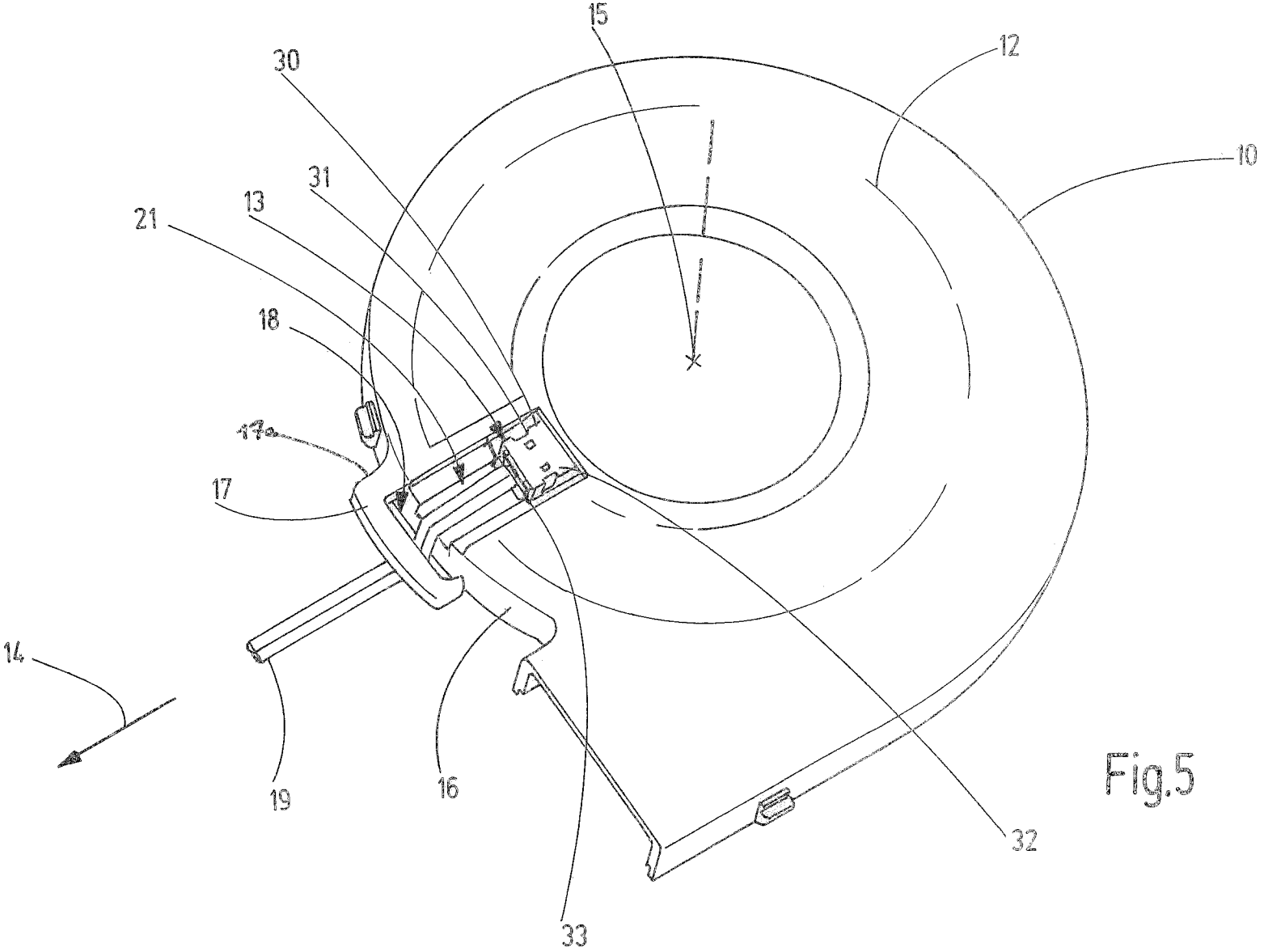
FIG. 5 shows a perspective view of the underside of the housing of the fan without a cover element.
Figure 6:
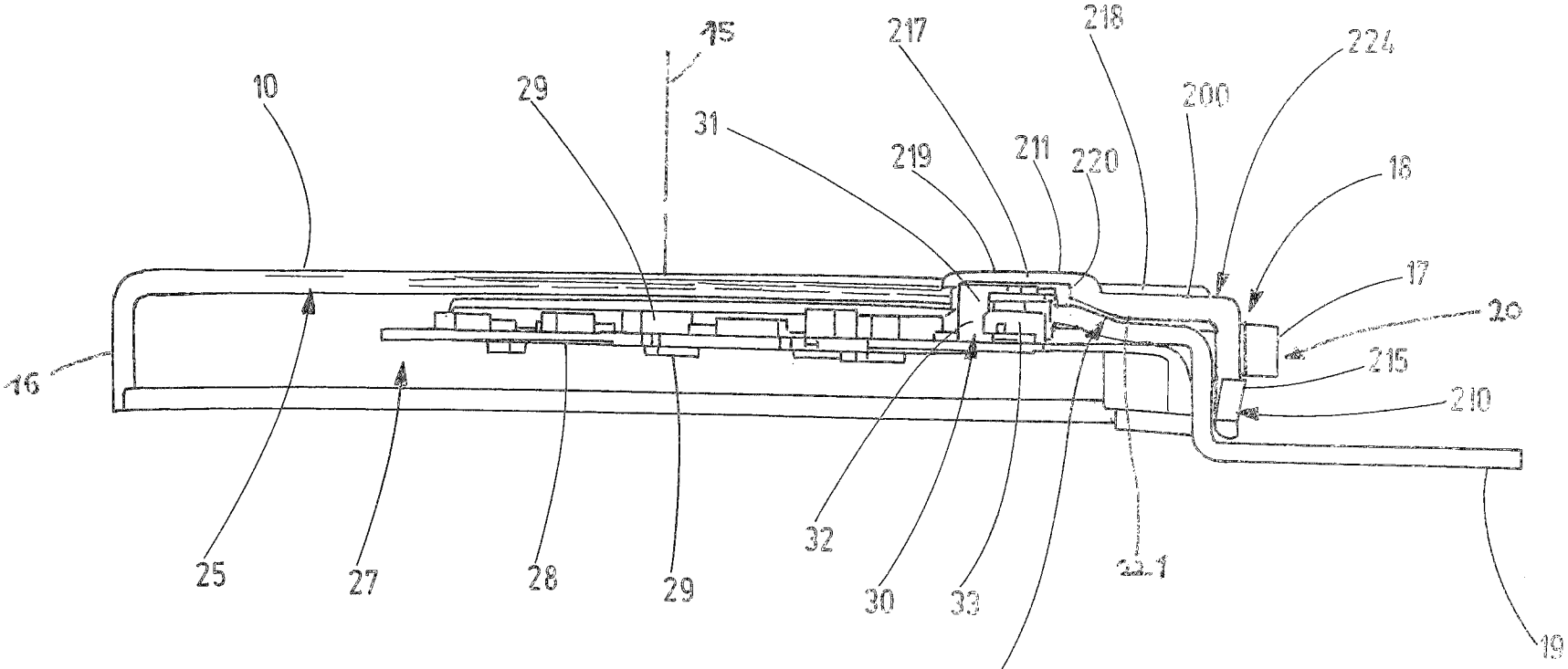
FIG. 6 shows a sectional view of the fan.

According to FIGS. 1 to 6, the fan 100 has a housing 10, wherein in the housing 10 a fan wheel 11 drivable or driven by a not depicted electric motor is arranged. On an underside of the housing 12 of the housing 10, seen in a radial direction 14, an opening 13 is arranged approximately between the axis of rotation 15 of the fan wheel 11 and a circumferential side 16 of the housing (FIGS. 3, 5 and 6). The opening 13 is provided for an electric outlet 30 for power supply of the electric motor arranged in the inside of the housing 27, which is not further depicted in more detail. On the circumferential side 16 the housing has a bracket 17 attached with a bracket end 17*a* at the circumferential side 16, so that a bushing 18 is formed between the bracket 17 and the circumferential side 16. The bushing 18 is open on one side. An electric line 19 is arranged at least partially at the underside of the housing 12 and is guided through the bushing 18. As can be seen in FIG. 2, in particular, a cover element 200 is arranged at the underside of the housing 12. As can easily be seen in FIGS. 7 and 8, the cover element 200 has a first section 210 and a second section 211. The first section 210 and the second section 211 are arranged at an angle towards each other, so that the cover element 200 is essentially formed L-shaped. According to FIG. 1, the first section 210 of the cover element 200 is at least partially arranged in the bushing 18 and guided through the latter, so that the electric line 19 is clamped in the bushing 18 while forming a strain relief 20. The second section 211 of the cover element 200 covers the opening 13 (FIG. 2). As can be seen particularly from FIG. 5, a recess 21 running in the underside of the housing 12 in the radial direction 14 starting from the opening 13 to the circumferential side 16 is formed, in which the electric line 19 is arranged. From the sectional view according to FIG. 6 it can be seen that the second section 211 with the underside of the housing forms 12 a covered duct 22. The recess 21 is formed by a respective shaping 23 of the housing wall 24 of the housing 10. As can be seen in FIGS. 3 and 4, seen from an inner side of the housing 25 the recess 21 is formed in the shape of a bulge 26. Further, in the inside of the housing 27 a printed circuit board 28 is arranged on an inner side of the housing 25, which covers the opening 13 from the direction of the inner side of the housing 25 (FIG. 4). Electronic components 29 for controlling the fan 100 are arranged on the printed circuit board 28.

For providing the electric outlet 30, a plug connection 31 is provided on the printed circuit board 28. The plug connection 31 comprises a first female part 32 and a second male part 33 arranged therein. The first female part 32 is attached to the printed circuit board 28 as an SMD component in an SMT procedure and protrudes through the opening 13. The second male part 33 is arranged at the end of the electric line 19. As is shown in FIGS. 3 and 6, the plug connection 31 comprising the first female part 32 and the second male part 33 is covered by the second section 211 of the cover element 200.

As can be easily seem in FIGS. 7 and 8, the cover element 200 comprising the first section 210 and the second section 211 is essentially formed L-shaped. The first section 210 has two longitudinal bars 212*a*, 212*b* and one cross bar 213 transversely arranged at the end of the longitudinal bars 212*a*, 212*b*. Therefore, the first section 210 has an opening 214. A latching element 215 protruding from the extension level of the first section 210 at an angle is arranged at the cross bar 213. This latching element 215 engages behind the bracket 17, if it is arranged at the housing 10 of the fan 100, as can be particularly seen in FIG. 6. The second section 212 of the cover element 200 has two longitudinally extending margin bars 216*a*, 216*b*. A cover plate 217 extends between the margin bars 216*a*, 216*b*, which, if arranged at the housing 10, covers the recess 21 in the underside of the housing 12 for forming the duct 22. The second section 211 is divided into a first partial section 218 and a second partial section 219. Between the first partial section 218 and the second partial section 219 a step 220 is formed on the underside 221 of the second section 211. If arranged at the housing 10, as can be seen in FIG. 6, the second male part 33 of the plug connection 32 is in a stop to the step 220 of the cover element 200, by which the male part 33 is secured in the plug connection 31. In the region of the step 220 the first partial section 218 has a bulged, arched or tapered transition region 222. As is shown in FIG. 6, the transition region 222 conduces to a load-free guiding of the electric line 19 in the outlet region to the second part 33 of the plug connection 31. The cover plate 217 at least in the second partial section 219 and partially also in the first partial section 218 has wing sections 223 which on a top side 224 of the cover element 200 protrude laterally beyond the margin bars 216*a*, 216*b*. If arranged at the housing 10, the wing elements 223, as shown in FIG. 2, abut on the underside of the housing 12.

At an end 225 of the cover plate 217 facing away from the first section 210, an end piece 226 is arranged, which, if arranged at the housing 10, abuts on the underside of the housing 12. Additionally, the margin bars 216*a*, 216*b* each have a latching protrusion 227 at an end 225 facing away from the first section 210. If arranged at the housing 10, in which the margin bars 216*a*, 216*b* are arranged in the recess 21, the margin bars 216*a*, 216*b* are also partially arranged in the opening 13, so that the latching protrusions 227 engage behind the housing wall 24 of the underside of the housing 12 (FIG. 3).

The cover element 200 is made of an electrically insulating material, such as a plastic, a glass or a ceramic, in order to enable an ESD protection.

The invention claimed is:

1. A fan comprised:

a housing with an underside of the housing, wherein within the housing an electric motor and a fan wheel drivable or driven by the electric motor are arranged;

the underside of the housing further configured with a circumferential side, said circumferential side configured parallel to the axis of rotation of the fan wheel;

wherein, on the underside of the housing, the housing has an opening for an electric outlet arranged approximately between the axis of rotation of the fan wheel and the circumferential side;

wherein, on the circumferential side the housing has a bracket, so that a bushing is formed between the bracket and the circumferential side;

wherein, an external electric line is arranged at least partially at the underside of the housing and is guided through the bushing between the bracket and the circumferential side of the housing, to the interior of the underside of the housing, said bushing configured so that the electric line runs via an edge at the bushing from the circumferential side to the interior of underside of the housing;

wherein, a cover element is arranged at the underside of the housing, said cover element further comprising a first section and a second section, said first and second sections are arranged at an angle towards each other; and, wherein the cover element is configured at the underside of the housing in such a way that the first section is at least partially disposed in the bushing and clamps the electric line in the bushing while forming a strain relief, and in that the second section covers the opening.

2. The fan according to claim 1, characterized in that a duct is formed between the second section and the underside of the housing, wherein the electric line is arranged in the duct.

3. The fan according to claim 1, characterized in that in an inside of the housing a printed circuit board is arranged, wherein the printed circuit board essentially covers the opening from the direction of an inner side of the housing.

4. The fan according to claim 3, characterized in that the electric outlet is provided, comprising a first part of a plug connection arranged on the printed circuit board, which protrudes through the opening and is covered by the second section, and in that the electric outlet comprises a second part of the plug connection arranged at the end of the electric line, which is in operative connection with the first part.

5. The fan according to claim 1, characterized in that the first section is formed bracket-shaped with two longitudinal bars and one cross bar arranged at the end of the longitudinal bars.

6. The fan according to claim 1, characterized in that the second section has two longitudinal margin bars and one cover plate extending between the margin bars.

7. The fan according to claim 6, characterized in that the second section has a first partial section and a second partial section, wherein a step is formed on an underside of the cover plate between the first partial section and the second partial section.

8. The fan according to claim 7, characterized in that the second part of the plug connection abuts on the step of the second section, so that the second part is prevented from gliding out of the first part.

9. The fan according to claim 7, characterized in that the first partial section has a bulged or arched transition region in the region of the step.

10. The fan according to claim 6, characterized in that the cover plate at least in the second partial section has wing sections which on a top side of the cover element protrude laterally beyond the margin bars, and/or in that an end piece sticks out in the direction of the underside of the cover element at an end of the cover element facing away from the first section.

11. The fan according to claim 6, characterized in that the margin bars each have a latching protrusion at an end facing away from the first section, and in that the latching protrusions at the margin bars engage behind the opening.

12. The fan according to claim 1, characterized in that the cover element consists of an electrically insulating material.

13. The fan according to claim 1, wherein the cover element comprising a first section and a second section is essentially formed L-shaped.

14. The fan according to claim 13, characterized in that the second section has two longitudinal margin bars and one cover plate extending between the margin bars, wherein the second section has a first partial section and a second partial section, wherein a step is formed on an underside of the cover plate between the first partial section and the second partial section.

15. The fan according to claim 14, characterized in that the first partial section has a bulged or arched transition region in the region of the step.

16. The fan according to claim 2, characterized in that the housing in the underside of the housing has a recess which runs in a radial direction, wherein the second section covers the radial recess for forming the duct.

17. The fan according to claim 5, characterized in that a latching element protruding from an extension level of the first section at an angle is arranged at the cross bar, and in that the latching element engages behind the bracket.

18. The cover element according to claim 13, characterized in that the first section is formed bracket-shaped with two longitudinal bars and one cross bar arranged at the end of the longitudinal bars, wherein a latching element protruding from an extension level of the first section at an angle is arranged at the cross bar.

19. The cover element according to claim 14, characterized in that the cover plate at least in the second partial section has wing sections which on a top side of the cover element protrude laterally beyond the margin bars.

* * * * *